US010598330B2

(12) United States Patent
Mayer et al.

(10) Patent No.: US 10,598,330 B2
(45) Date of Patent: Mar. 24, 2020

(54) HEADLIGHT FOR VEHICLES

(71) Applicant: ZKW GROUP GMBH, Wieselburg (AT)

(72) Inventors: Matthias Mayer, Mank (AT); Stefan Mitterlehner, Mank (AT)

(73) Assignee: ZKW Group GmbH, Wieselburg (AT)

( * ) Notice: Subject to any disclaimer, the term of this patent is extended or adjusted under 35 U.S.C. 154(b) by 0 days.

(21) Appl. No.: 16/106,235

(22) Filed: Aug. 21, 2018

(65) Prior Publication Data

US 2018/0356062 A1 Dec. 13, 2018

Related U.S. Application Data

(63) Continuation-in-part of application No. PCT/AT2017/060013, filed on Feb. 1, 2017.

(30) Foreign Application Priority Data

Feb. 24, 2016 (AT) ..... A 50129/2016

(51) Int. Cl.

| | |
|---|---|
| ***F21S 41/25*** | (2018.01) |
| ***F21S 41/675*** | (2018.01) |
| ***F21S 41/663*** | (2018.01) |
| ***F21S 41/265*** | (2018.01) |
| ***F21S 41/147*** | (2018.01) |
| ***F21S 41/36*** | (2018.01) |

(52) U.S. Cl.

CPC ..... *F21S 41/25* (2018.01); *F21S 41/147* (2018.01); *F21S 41/265* (2018.01); *F21S 41/36* (2018.01); *F21S 41/663* (2018.01); *F21S 41/675* (2018.01)

(58) Field of Classification Search

CPC ..... F21S 41/675

See application file for complete search history.

(56) References Cited

U.S. PATENT DOCUMENTS

2015/0191115 A1* 7/2015 Yamamura ..... F21S 41/143 315/82

* cited by examiner

*Primary Examiner* — Joseph L Williams
*Assistant Examiner* — Jacob R Stern
(74) *Attorney, Agent, or Firm* — Eversheds Sutherland (US) LLP

(57) ABSTRACT

A headlight for vehicles including at least one light source and an illumination optics system associated therewith, comprising a micromirror array and a projection optics system. A central processing unit comprising a light source control unit and an array control unit is associated with the light source and the micromirror array. The shaped rays of light of the light source are directed at the micromirror array, and the reflected light beam structured thereby is projected by the projection optics system as a light image into a traffic space. At least two light sources are provided, the rays of light of which are directed at a micromirror array common to the light sources, and at least two superimposed regions of a projection optics system having different refractive powers for at least two image regions of the light image are associated with the light beam reflected by the micromirror array.

7 Claims, 4 Drawing Sheets

HEADLIGHT FOR VEHICLES

CROSS-REFERENCE TO RELATED APPLICATIONS

This is a continuation-in-part of International Application No. PCT/AT2017/060013, filed Feb. 1, 2017, which claims priority to Austrian Patent Application No. A 50129/2016, filed Feb. 24, 2016. The applications are incorporated by reference herein.

TECHNICAL FIELD

The invention relates to a headlight for vehicles, comprising at least one light source and an illumination optics system associated therewith, comprising a micromirror array and a projection optics system designed as a lens, wherein a central processing unit including a light source control unit and an array control unit is associated with the light source and the micromirror array, the shaped rays of light of the at least one light source are directed at the micromirror array, and the reflected light beam structured thereby is projected by way of the projection optics system in the form of a light image into the traffic space.

BACKGROUND

In the context of the present invention, the term "headlight" shall be understood to mean not only an entire vehicle headlight, but also an illumination unit, which together with other illumination units, for example, can form part of a headlight.

The development of current headlight systems always focuses on the desire of being able to project a light image onto the roadway that has the highest possible resolution, changes rapidly and can be adapted to the particular traffic, road and lighting conditions. The term "roadway" is used for simplified illustration here since, of course, it depends on the local circumstances whether a light image is in fact located on the roadway or also extends beyond. In principle, the light image, in the meaning in which it is used herein, corresponds to a projection onto a vertical surface in accordance with the relevant standards that refer to motor vehicle lighting technology.

In keeping with the aforementioned need, different headlight systems have been developed, such as, in particular, headlights operating with scanning, modulated laser beams, wherein the lighting-related starting point is at least one laser light source that emits a laser beam and is associated with a laser control unit, which is used for power supply purposes and for monitoring the laser emission or, for example, for controlling the temperature, and which is also configured to modulate the intensity of the emitted laser beam. "Modulating" shall be understood to mean that the intensity of the laser light source can be altered, either continuously or in a pulsed manner, within the meaning of switching on and off. What is essential is that the light output can analogously be dynamically altered, depending on the angular position of a mirror deflecting the laser beam. Additionally, there is also the option of switching on and off for a certain period of time so as not to illuminate or to suppress defined areas. The laser light sources and the micromirror used for beam deflection are controlled via a processing unit, also referred to as ECU (electronic or engine control unit) for short. One example of a dynamic control concept for generating an image by way of a scanning laser beam is described, for example, in document AT 514633 by the applicant.

Since such headlight system can, at times, be very complex and expensive, creating the desire for economical headlights that nonetheless exhibit high flexibility with respect to the generated light image, headlights have become known which utilize image generators as light processing elements, which comprise a large number of controllable pixel fields. DE 10 2013 215 374 A1, for example, shows approaches in which the light of a light source is directed by way of a light conducting element to an LCD image generator, and to an LCoS chip or to a micromirror array ("DMD"), so as to then be projected onto the roadway by way of a projection optics system.

Document DE 11 2013 003 050 T5 discloses a vehicle lamp in which the light of two LEDs is directed by way of a respective reflector onto a DMD, from where it is projected onto the roadway by way of a projection lens. It is possible to generate different illumination patterns on the DMD, which are reproduced on the roadway by the projection lens.

The document FR 3 008 477 A1 also shows a vehicle lamp comprising a projection lens and two light sources, the light of which is directed by way of two different mirror elements to the projection lens, and from there into the traffic space, so as to generate two light fields. This as well as the aforementioned lamp system uses customary lenses as the projection optics system, in which no distinction in terms of regions having different refractive power is possible.

DMD is an acronym denoting "digital micromirror device", and thus represents a micromirror array or a micromirror matrix. Such a micromirror array has very small dimensions, which are typically in the order of magnitude of 10 mm. In a DMD, micromirror actuators are arranged in a matrix-like manner, wherein each individual mirror element, which has an edge length of approximately 16 μm, for example, can be tilted by a certain angle, for example 20°, for example by electromagnetic or piezoelectric actuators. The end positions of a micromirror are referred to as the ON state and OFF state, wherein ON state shall be understood to mean that light from the micromirror reaches the road via the projection optics system, while it is directed onto an absorber, for example, in the OFF State. Typically, it will also be necessary to ensure absorption of those rays of light that originate from micromirrors when these are not in the "active" angular position thereof and that are not projected by way of the projection optics system onto the road. For this purpose, absorbers or absorber surfaces are used, which absorb what are otherwise harmful rays of light and convert them into heat.

The angle of each micromirror can be adjusted individually, wherein it is possible to switch between the end positions up to 5000 times per second. The number of mirrors corresponds to the resolution of the projected image, wherein a mirror can represent one or more pixels. DMD chips having high resolutions in the megapixel range are available today. The technology underlying the adjustable individual mirrors is the microelectromechanical systems (MEMS) technology.

While the DMD technology has two stable mirror states, and the reflections can be set by way of modulation between the two stable states, the "analog micromirror device" (AMD) technology allows the individual mirrors to be set in variable mirror positions.

A micromirror array-based headlight is described, for example, in DE 195 30 008 A1.

When it comes to headlights of motor vehicles, there is often the desire to implement multiple light functions in as compact a design as possible, such as in particular high beam, low beam, daytime running light and cornering light. Proceeding from a micromirror concept, in this case multiple micromirror arrays and multiple lenses are required for the projection optics system, which results in high material and manufacturing costs.

The configuration of a luminance pattern is implemented not only by way of the modulation of the primary light source, but also by way of different array control units for different light distributions, such as high beam, low beam with or without asymmetry, suppression scenarios and the like, wherein different array control units control the individual micromirror elements as a function of the desired light distribution.

It is an object of the invention to create a headlight that can be produced cost-effectively, but nonetheless offers large design freedom with respect to the light images that can be generated.

DETAILED DESCRIPTION

This object is achieved by a headlight of the type mentioned at the outset in which, according to the invention, at least two light sources are provided, the rays of light of which are directed at a micromirror array that is common to the light sources, and at least two superimposed regions of a projection optics system having different refractive powers for at least two image regions of the light image are associated with the light beam reflected by the micromirror array.

Thanks to the invention, it is possible to implement multiple light functions using a single micromirror array and a single projection optics system, which simplifies the overall construction and makes it more cost-effective. The division into multiple light sources, which usually have high outputs, also facilitates cooling.

It is furthermore advantageous when the shaped rays of light of the light sources are directed at the micromirror array at varying angles of incidence.

It is also recommended to divide the active mirror surface of the micromirror array into sub-regions, which are associated with the individual light sources.

It may be expedient if each light source is associated with an illumination optics system located between the light source and the shared micromirror array.

On the other hand, it may be provided, in the spirit of a particularly compact design, that two or more light sources are associated with an illumination optics system located between these and the shared micromirror array.

A cost-effective and space-saving design is also achieved by superimposing the two regions of the single projection optics system and designing them in a lens-like manner from a body made of optical glass/plastic material.

It may also be advantageous if the lens body is located in the front region of the headlight and a sub-optics system designed as a lens/lens system is arranged between the micromirror array and the lens body.

Another advantageous embodiment is characterized in that one region of the single projection optics systems is associated with one of the multiple light sources, while another region of the projection optics system is associated with two or more light sources.

The invention, along with further advantages, will be described in greater detail hereafter based on exemplary embodiments, which are illustrated in the drawings. In the drawings.

Figure 2:
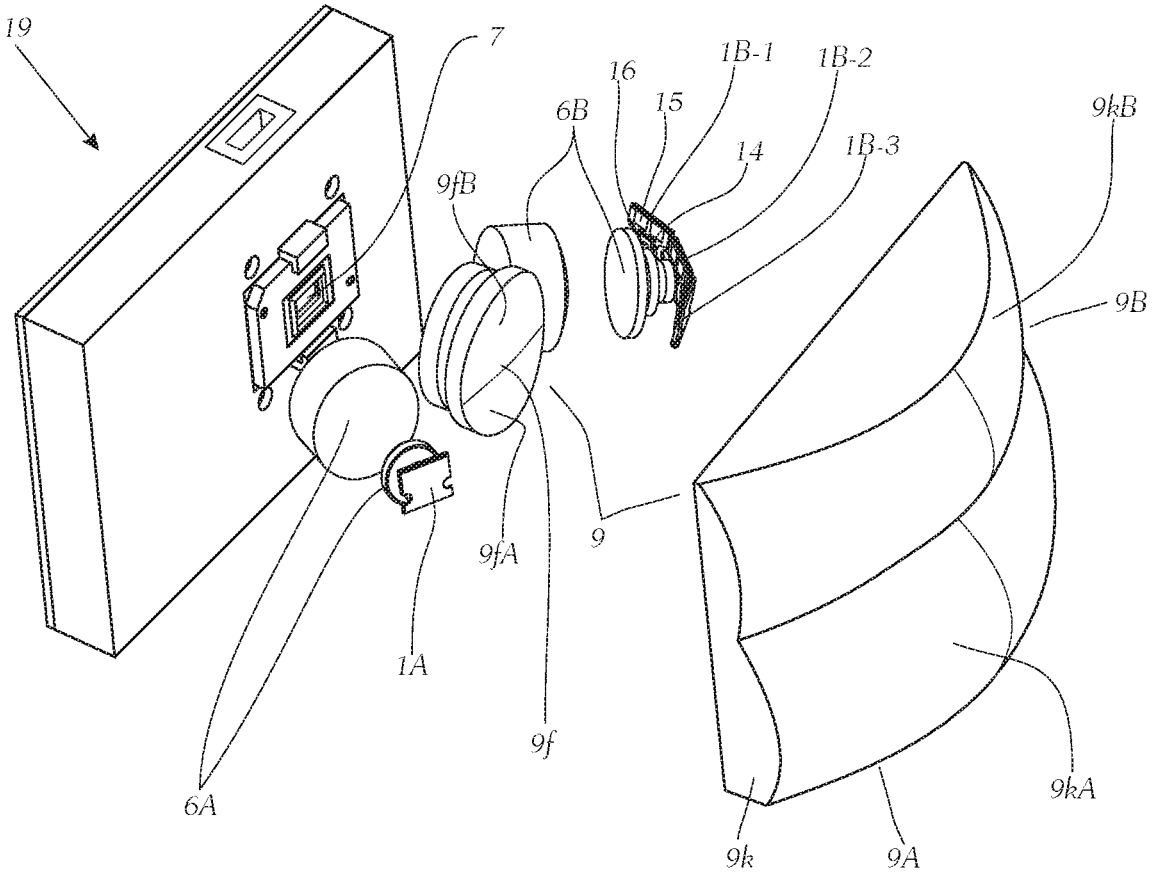
FIG. 2 shows a second exemplary embodiment of the invention in a perspective simplified illustration, highlighting the components that are essential to the invention.
Figure 4:
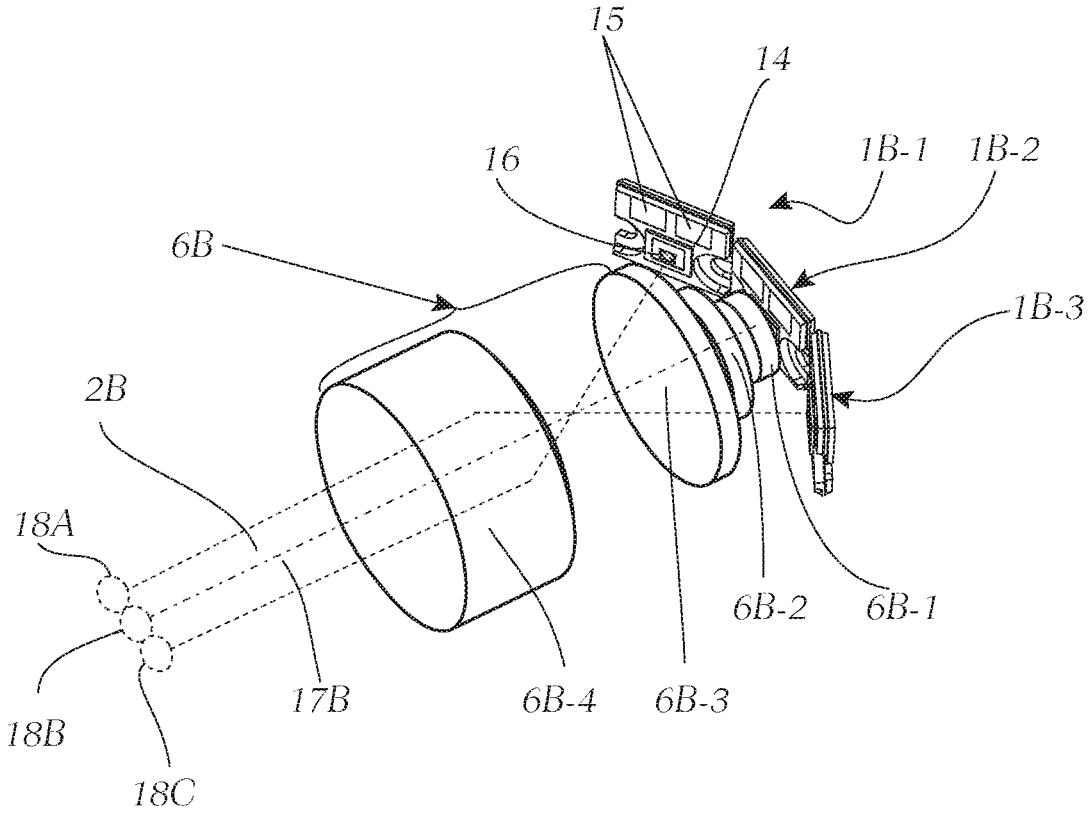
Figure 5:
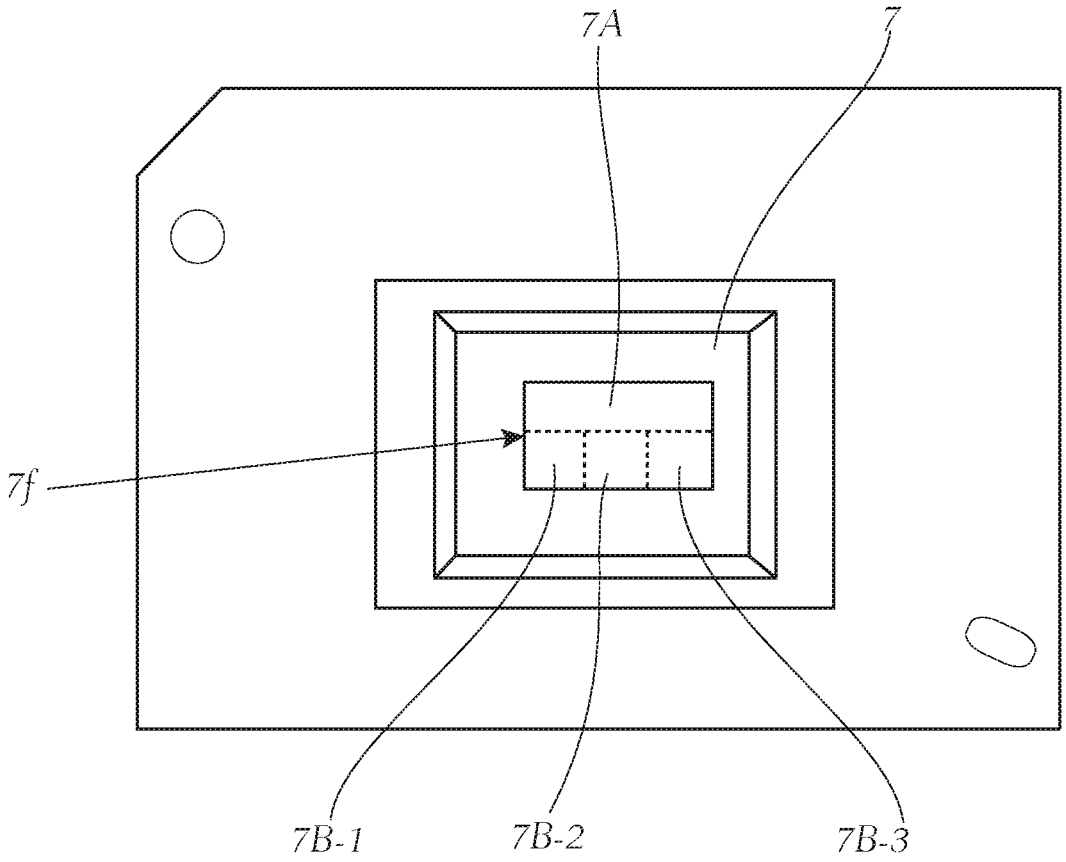
Figure 6:
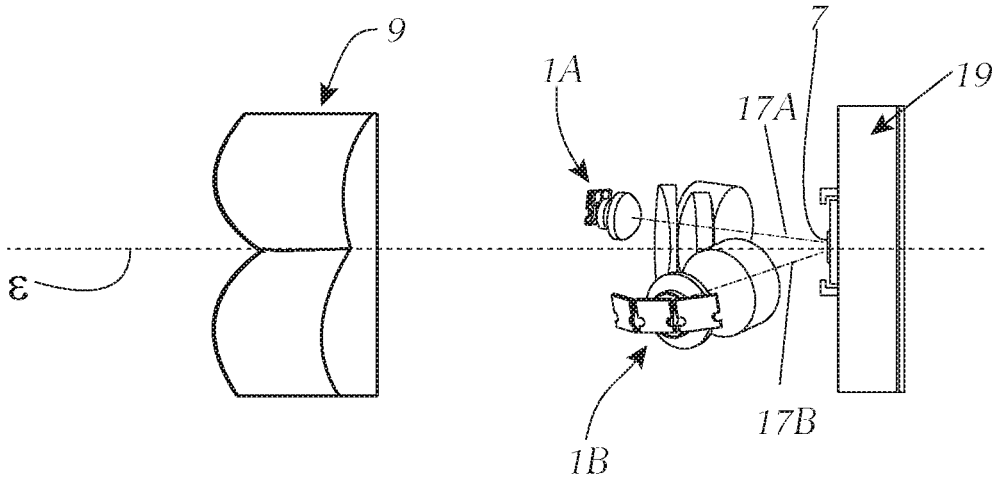

FIG. 4 an enlarged perspective view of a second illumination module of the embodiment according to FIG. 2, but seen from a different viewing angle;

FIG. 5 shows a front view of a DLP component used by way of example in the invention, comprising a micromirror array; and FIG. 6 shows a smaller side view of the embodiment according to FIG. 2 to illustrate the optical axes of the two illumination modules inclined with respect to the horizontal.

Referencing FIG. 1, one exemplary embodiment of the invention will now be described in greater detail. In particular, the parts important for a headlight according to the invention are shown, wherein it is clear that a motor vehicle headlight also contains a number of other parts that allow meaningful use of the headlight in a motor vehicle, such as in particular a passenger car or motorcycle. The lighting-related starting point of the headlight in the present case is two light sources 1A and 1B, which each emit a ray of light 2A, 2B and which are associated with a control unit 3, wherein this control unit 3 is used for power supply purposes of the light sources 1A and 1B and for monitoring these or, for example, for controlling the temperature, and can also be configured to modulate the intensity of the emitted ray of light. "Modulating" in the context of the present invention is understood to mean that the intensity of the light source can be altered, either continuously or in a pulsed manner, within the meaning of switching on and off. Additionally, there is also the option of switching on and off for a certain period of time.

Possible light sources include not only phosphor elements excited by laser radiation, but it is also possible to use traditional LEDs or high-current LEDs. It is also possible to use what are known as "LED packages," which in addition to a small light-emitting surface area, measuring 1 to 2 $mm^2$, for example, also include the substrate on the LED board and the support plate thereof. Preferably, LED light sources are used that can be operated with high currents, so as to achieve as high a luminance as possible on the DMD chip, at the lowest possible luminous flux. The control signals of the light sources are denoted by $U_{SA}$ and $U_{SB}$.

The control unit 3, in turn, receives signals from the central processing unit 4, which to which sensor signals $s_1 \ldots si \ldots s_n$ can be supplied. These signals can be switching commands for switching from high-beam light to low-beam light, for example, or signals recorded, for example, by sensors, such as cameras, which pick up the lighting conditions, environmental conditions and/or objects on the roadway. The signals can also stem from vehicle-to-vehicle communication information. The processing unit 4 shown here schematically in the form of a block can be included entirely or partially in the headlight, wherein a memory unit 5 is also associated with the processing unit 4.

An optics system 6A or 6B is arranged downstream of the light sources 1A, 1B, the embodiment of which depends, among other things, on the type, number and spatial arrangement of the luminous elements used, such as laser diodes or LEDS, and the required beam quality, and which, above all, is intended to ensure that the light emitted by the light source impinges upon the micromirrors of a micromirror array 7 as homogeneously as possible.

The focused or shaped ray of light 2 arrives at this micromirror array 7 on which, by way of an appropriate position of the individual micromirrors, a luminous image 8 is formed, which can be projected by way of a projection optics system 9 in the form of a light image 10 onto a roadway 11 or, generally speaking, into the traffic space. In this embodiment, the projection optics system 9 comprises a lens body 9*k* including two regions 9*k*A and 9*k*B, which are arranged on top of one another here and together are shaped in a lens-like manner, made of optical glass or plastic material. The processing unit 4 supplies signals $s_a$ to an array control unit 12, which controls the individual micromirrors of the array 7 in the appropriate manner for the desired light image. The individual micromirrors of the array 7 can be individually controlled in terms of the frequency, the phase and the deflection angle.

Figure 1:
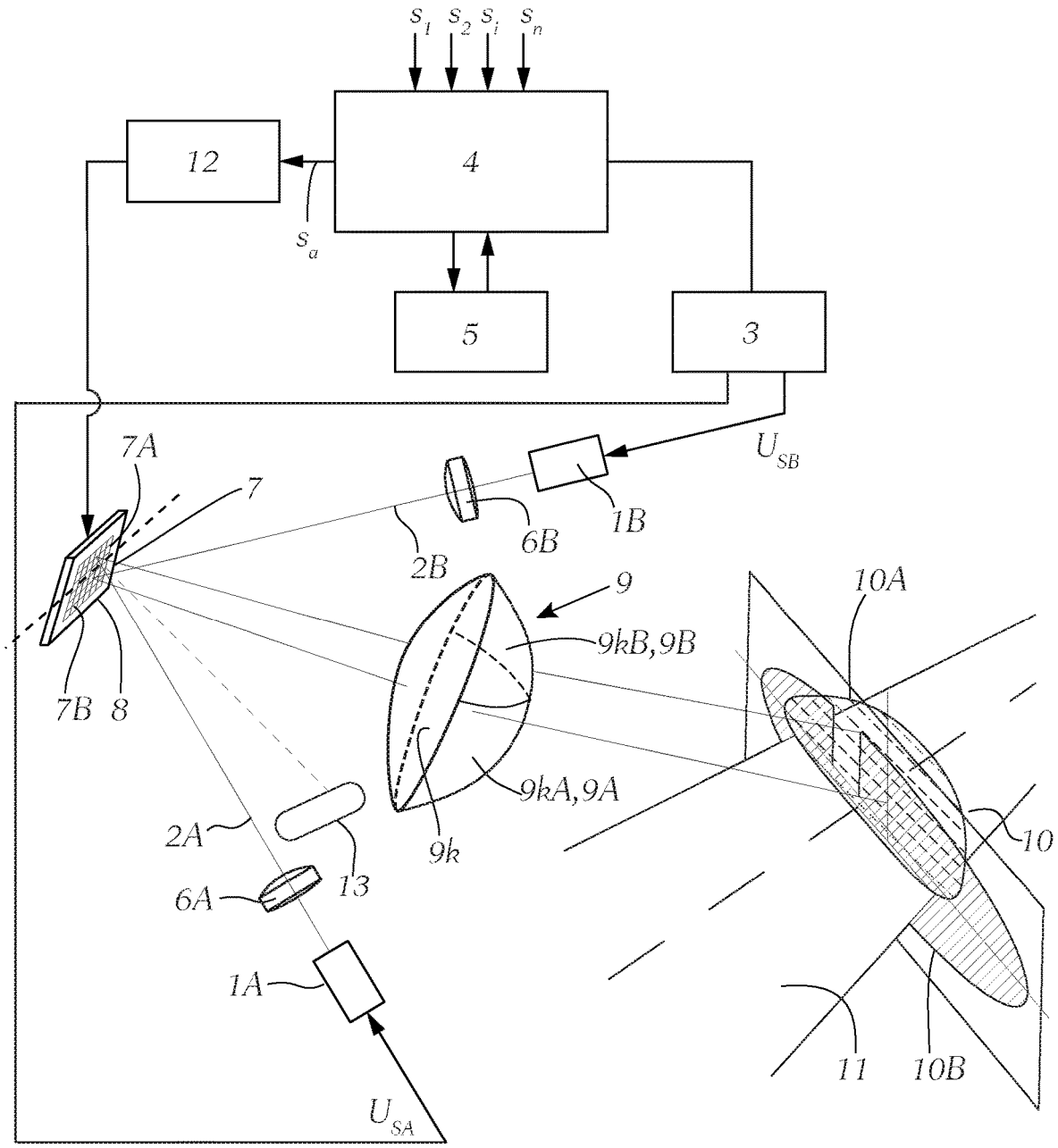
FIG. 1 shows components of a first embodiment of a headlight that are essential to the invention, comprising a micromirror array, in a schematic illustration.

FIG. 1 also depicts an absorber 13, which was already mentioned above and generally is important for a high quality of the generated image.

The active mirror surface of the micromirror array 7 is divided into sub-regions 7A and 7B here, which are associated with the two light sources 1A, 1B. Furthermore, the light beam reflected by the array 7, or by the sub-regions 7A, 7B thereof, are associated with two regions 9A, 9B of the projection optics system 9, wherein consequently the light image 10 is also composed of two image regions 10A and 10B.

Referencing FIG. 2, an exemplary embodiment of the invention will be described hereafter based on a headlight according to FIG. 1, however comprising further components that are essential to the invention, wherein components that are not essential for the description of the invention and were already shown in FIG. 1 have been omitted, as were other mechanical parts, such as fastening means, housings, cooling units, power supply units and the like.

Figure 3:
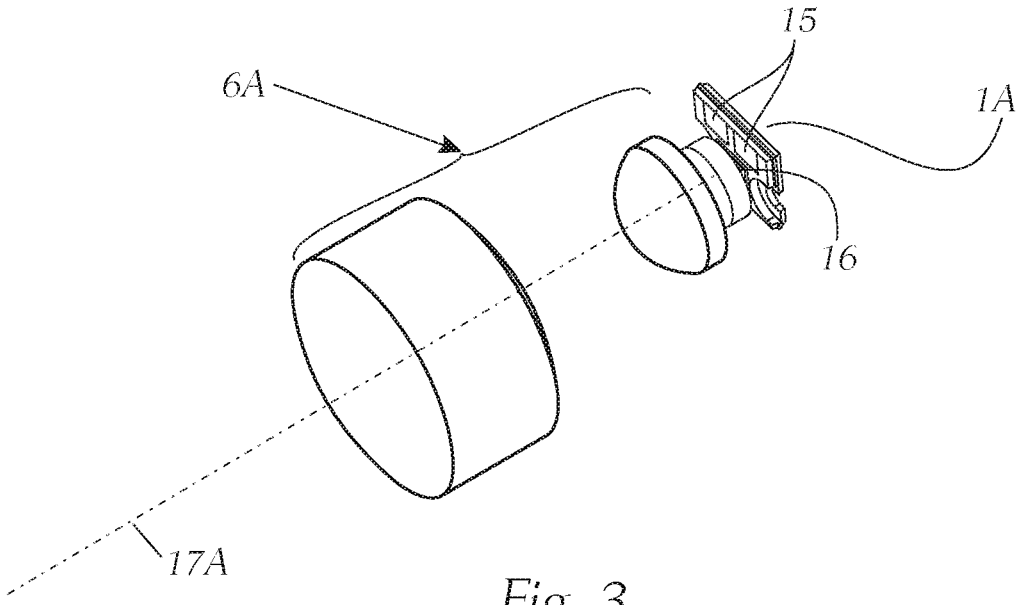
FIG. 3 shows an enlarged perspective view of a first illumination module of the embodiment according to FIG. 2, but seen from a different viewing angle.

In detail, the first light source 1A comprising the first illumination optics system 6A is apparent, for which additionally reference is made to the enlarged illustration in FIG. 3. The first light source 1A comprises an LED chip 14 including connecting contacts 15 and a light-emitting surface 16 of a high performance LED. The optical axis associated with the light source 1A, or with the associated illumination optics system 6A, is denoted by reference numeral 17A.

In contrast to the light source 1A, the light source 1B is composed of three light sub-sources 1B-1, 1B-2 and 1B-3. In the present exemplary embodiment, each of these light sub-sources is designed in the same manner as the light source 1A, so that a more detailed description can be dispensed with. Identical reference numerals are used here and hereafter for identical or comparable parts.

To combine the light of the three light sub-sources 1B-1, 1B-2 and 1B-3 emitted by the light-emitting surfaces 16 so as to form an assembled ray of light 2B having essentially an optical axis 17B, a slightly more complex illumination optics system 6B is required for these light sources, which here is composed of a lens combination located close to the light source, composed of three sub-lenses 6B-1, 6B-2, 6B-3 and a further lens 6B-4 arranged downstream of the sub-lenses, as is apparent from FIG. 4. The illumination optics systems, which are not shown in detail and, per se, are not the subject matter of the invention, are preferably multi-stage optics system, which must collect the Lambert's emission characteristics and shape these into a respective luminous spot 18A, 18B, 18C having a suitable geometry on the mirror array 7. FIG. 4 schematically indicates such luminous spots.

The array 7 is composed of a matrix of micromirrors and represents the optically significant region of a DMD component 19. In addition to the micromirror array, such DMD components usually include sub-regions of the driver electronics and are equipped with an effective cooling system. As was already mentioned at the outset, a large number of, for example (Texas Instruments DLP3000DMD) 608×684, micromirrors are arranged on the DMD chip on a surface area having a diagonal of 7.62 mm, which can be pivoted by +/−12 degrees. The micromirror is usually driven electrostatically.

The projection optics system 9 is also designed as a multi-stage lens system and, in this variant, comprises a lens body 9*k* that is located at the front end of the headlight and includes two regions 9*k*A and 9*k*B, which are arranged on top of one another here and together are shaped in a lens-like manner, made of optical glass or plastic material. In general, at least one sub-optics system 9*f* will be arranged between the mirror array 7 and the lens body 9*k*, in addition to this lens body 9*k* of the projection optics system 9. This sub-optics system 9*f* is also generally designed in the form of a lens, which has different refractive powers in an upper and a lower region 9*f*A and 9*f*B, for example.

In the view shown in FIG. 5, it is apparent that the optically active surface area of the mirror array 7, which is to say the mirror surface 7*f*, is divided into sub-regions 7A, 7B-1, 7B-2 and 7B-3, which, analogously to the embodiment according to FIG. 1, are associated with the four light sources 1A, 1B-1, 1B-2 and 1B-3. Again, the luminous image generated here is projected by the illumination optics system 9 onto the roadway as a corresponding light image, which is composed of four image regions here. This was already shown based on FIG. 1 and does not require explanation again for a person skilled in the art. The skilled practitioner, however, will recognize that the overall design, despite the presence of four individual light sources, can have a relatively simple, compact and cost-effective design thanks to the invention.

The side view of FIG. 6 is intended to illustrate the positions of the optical axes of the above-described exemplary embodiment with respect to a horizontal plane c, according to which the optical axis 17A of the light source 1A is located above, and the optical axis 17B of the light source 1B composed of the three light sub-sources 1B-1, 1B-2 and 1B-3 is located beneath, the plotted horizontal planes. It should be clear that the terms "above" and "beneath" are not limiting to the invention, but shall only be understood in connection with the shown view and can refer, for example, to a normal usage position of a vehicle. The same applies analogously to the terms "left," "right," "front," "rear," "laterally" and the like.

LIST OF REFERENCE SIGNS

1A light source
1B light source
1B-1 light sub-source
1B-2 light sub-source
1B-3 light sub-source
2A ray of light
2B ray of light

3 control unit
4 processing unit
5 memory unit
6A illumination optics system
6B illumination optics system
6B-1 sub-lens
6B-2 sub-lens
6B-3 sub-lens
6B-4 lens
7 micromirror array
7A sub-region of 7
7B sub-region of 7
7B-1 sub-region of 7
7B-2 sub-region of 7
7B-3 sub-region of 7
7*f* mirror surface
8 luminous image
9 projection optics system
9*f* sub-optics system
9*f*A region
9*f*B region
9*k* lens body
9*k*A region of 9*k*
9*k*B region of 9*k*
10 light image
10A image region
10B image region
11 roadway
12 array control unit
13 absorber
14 LED chip
15 connecting contacts
16 light-emitting surface
17A optical axis
17B optical axis
18A luminous spot
18B luminous spot
18C luminous spot
19 DMD component
$s_1 \ldots s_n$ sensor signals
$s_a$ signals
$U_{SA}$ control signal
$U_{SB}$ control signal
ε horizontal plane That which is claimed is:

1. A headlight for vehicles, comprising:

at least two light sources (1A, 1B; 1B-1, 1B-2, 1B-3); and an illumination optics system associated with one of the at least two light sources, the illumination optics system comprising a micromirror array (7) and a projection optics system (9, 9*f*) comprising a lens, a central processing unit (4) comprising a light source control unit (3) and an array control unit (12) associated with the at least two light sources and the micromirror array, wherein the illumination optics system is configured to direct shaped rays of light (2A, 2B) of one of the at least two light sources at the micromirror array, and wherein a reflected light beam is projected by the projection optics system as a light image (10) into a traffic space, wherein rays of light from the at least two light sources are directed at the micromirror array (7) that is common to the at least two light sources, and wherein at least two superimposed regions (9*k*A, 9*k*B) of the projection optics system (9, 9*f*), which have different refractive powers for at least two image regions of the light image are associated with the reflected light beam, and wherein the rays of light of the at least two light sources (1A, 1B; 1B-1, 1B-2, 1B-3) are directed at the micromirror array (7) at varying angles of incidence.

2. The headlight according to claim 1, wherein an active mirror surface (7*f*) of the micromirror array (7) is divided into sub-regions, which are associated with individual light sources of the at least two light sources.

3. The headlight according to claim 1, wherein one light source (1A, 1B) of the at least two light sources is associated with the illumination optics system (6A, 6B) located between the at least two light sources and the micromirror array (7).

4. The headlight according to claim 1, wherein two or more light source (1B-1, 1B-2, 1B-3) of the at least two light sources are associated with the illumination optics system (6B) located between the at least two light sources and the micromirror array (7).

5. The headlight according to claim 1, wherein the at least two superimposed regions (9*k*A, 9*k*B) of the projection optics system (9) are superimposed and designed in a lens-like manner from a lens body (9*k*) made of optical glass/plastic material.

6. The headlight according claim 5, wherein the lens body (9*k*) is located in a front region of the headlight, and a sub-optics system (9*f*) comprising a lens is arranged between the micromirror array (7) and the lens body.

7. The headlight according to claim 1, wherein one region (9*k*A) of the projection optics system (9) is associated with one (1A) of the at least two light sources, while another region (9*k*B) of the projection optics system is associated with two or more light sources (1B-1, 1B-2, 1B-3) of the at least two light sources.

* * * * *